US006750409B1

(12) United States Patent
Samodell

(10) Patent No.: US 6,750,409 B1
(45) Date of Patent: Jun. 15, 2004

(54) POWER SWITCH FOR WELDER

(75) Inventor: Ralph M. Samodell, Willoughby Hills, OH (US)

(73) Assignee: Lincoln Global Inc., Monterey Park, CA (US)

( * ) Notice: Subject to any disclaimer, the term of this patent is extended or adjusted under 35 U.S.C. 154(b) by 157 days.

(21) Appl. No.: 10/050,702

(22) Filed: Jan. 18, 2002

Related U.S. Application Data

(60) Provisional application No. 60/340,136, filed on Dec. 14, 2001.

(51) Int. Cl.[7] ..... H01H 9/00

(52) U.S. Cl. ..... 200/50.32; 200/1 B; 200/48 R; 200/334

(58) Field of Search ..... 200/1 R, 17 R, 200/18, 1 B, 42.01, 48 R, 48 A, 48 SB, 48 CB, 49, 50.32, 50.37, 573, 574, 334, 335; 218/2, 8, 12, 45, 67, 80, 100

(56) References Cited

U.S. PATENT DOCUMENTS 4,181,838 A * 1/1980 Neuser et al. ..... 200/573
5,772,011 A * 6/1998 Dumont ..... 200/573
5,933,065 A * 8/1999 Duchemin ..... 335/190

* cited by examiner

*Primary Examiner*—Michael A. Friedhofer
(74) *Attorney, Agent, or Firm*—Fay, Sharpe, Fagan, Minnich & McKee

(57) ABSTRACT

A mechanical power switch for selectively connecting a power source to an input power supply where the power source has an override circuit to deactivate the power source when in a first condition and allowing activation of the power source when in a second condition. The power switch has electrical contacts movable between an open condition with the power source electrically disconnected from the power supply and a closed condition with the power source electrically connected to the power supply and an operating lever movable between a first position with the switch in the open condition and a second position with the switch in the closed condition. An auxiliary switch in said override circuit has a movable element with a first orientation to shift the override circuit into the first deactivate condition and a second orientation to shift the override circuit into the second activate condition. The switch lever of the main switch causes the movable element of the auxiliary switch to move into the first orientation before the lever moves to the first position, but during movement of the lever from the second position to the first position.

36 Claims, 4 Drawing Sheets

POWER SWITCH FOR WELDER

This application claims the benefit of provisional application No. 60/340,136, filed Dec. 14, 2001.

The present invention relates to the art of electric arc welding and more particularly to an input power switch for a welder and/or plasma cutter.

BACKGROUND OF INVENTION

Industrial electric arc welders include a power source that must be connected to and disconnected from a line power supply, which is a single phase or three phase network. To make the connection between the power source and power supply, a manually operated toggle switch is normally used to toggle between a closed condition wherein the switch electrically connects the power source to the power supply and an open condition where the power source is disconnected from the power supply. The main power toggle switch is well known in the electric arc welding field; however, it must be designed to have long life and acceptable temperature limits during operation. To assure long term operation, such main power switches must be certified as meeting standards, such as passing a life test of 6000 cycles at 6 cycles per minute with a one second minimum time delay between cycles. When the output power source is shorted, the compliance test requires 100 cycles without failure. The mechanical toggle switch needs to have a maximum contact temperature rise of 40° C., as well as meeting the 100 cycle shorted output switching test. To assure compliance with these operating conditions, it has been common practice to replace the input line switch of a welder with an expensive input line connector relay with an overcurrent protected pilot transformer having a low current pilot switch. By activating and deactivating the power connector coil the input power is turned on and off. In other words, simple mechanical toggle power switches, that have been used for many years in lower capacity power sources, do not provide the heat and arcing protection meeting the demands of the larger electric arc welders. Consequently, very expensive contact or relays have been suggested and used to comply wit the switching requirements. Such relays require a power supply that demands a separate and distinct auxiliary power supply to operate the relay mechanism. These relays complicate the welder design and increases the cost and complexity over standard mechanical toggle switches used for years.

THE INVENTION

The present invention relates to the an improved mechanical power switch for an electric arc welder. As is well known, such welders often include an override protection circuit having thermostats for sensing temperature levels of the transformer windings, chokes and other electrical components subjected to temperature rises. The power source, such as an inverter or SCR rectifier, is deactivated when one of the thermostats of the override protection circuit detects an overheat condition. These thermal shut down conditions are communicated to the operator, usually by a panel light which is activated when the override heat sensing circuit has sensed an overtemperature condition. When the thermostat resets, the panel light is extinguished. The improved mechanical power switch of the present invention is designed to utilize the existing override circuit of a welder. The override circuit normal in welders is used to substantially extend the switching life of the input main power switch of the electric arc welder. A standard toggle main power switch is provided with a normally opened microswitch mounted on the power switch so the mechanical operation of the toggle lever of the power switch closes the normally opened contacts of a microswitch. After the power contacts are closed to provide input power to the power source, the microswitch is operated to close its normally open contacts. In a like manner, the microswitch is released so the normally opened switch is shifted to the normal position before the power switch contacts are opened. Thus, the power source is deactivated before the main contacts are opened. By putting the normally opened contacts of the microswitch in series in the override temperature sensing protection circuit of the welder, the welder power supply is deactivated or disabled by opening the normally opened contacts when the toggle switch is toggled toward the opened condition of the contacts. After the lever of the toggle switch is toggled into the closed contact condition, the microswitch actuator is depressed to close the normally opened contacts of the microswitch and enable the power supply. By connecting the normally opened microswitch contacts in series with the thermostats contacts of the override protection circuit, the welder output will shut down whenever the microswitch contacts are opened. If the main toggle switch opens the normally opened contacts of the microswitch without following through to open the line contacts, the thermal light panel indicator will turn on to indicate the welder shut down. Conversely, when the main toggle switch toggle lever closes the power contacts, the thermal light momentarily blinks on to indicate the short delay in activating the output. The microswitch contacts are initially opened They are closed after the main line contacts are closed. Thus, there is a slight delay in welder start. By using the present invention, main power toggle switches that have previously been unsuccessful in passing the cycle life and temperature requirements for certification have easily exceeded the cycle life test requirements with substantially less arcing and virtually no contact erosion. Consequently, by the mere addition of the auxiliary microswitch onto the standard mechanical power switch, the power switch is converted into a mechanical switch meeting all requirements of temperature and arcing.

The present invention involves the addition of a microswitch with a normally opened contact placed in series in the standard thermostat override or protection circuit of an electric arc welder. An extension or finger on the toggle lever of the toggle switch engages and depresses the actuator of the microswitch to close the normally opened contacts in the override circuit when the main switch is closed. As the main switch is opened, the extension of the toggle lever releases the actuator of the microswitch. This immediately opens the normally open contact in the override circuit to disable the power source. This first movement releases the microswitch before opening the line contacts. Thus, the power source is initially deactivated as the toggle switch is moved into the disconnect condition. Consequently, disconnection of the line contacts is accomplished at a deactivated or low input level of the power source. Deactivation means both off or low input level to the power source. This opening of the line contacts at low input prevents overheating and drastically reduces arcing. This is the main feature of the present invention. The microswitch used in the present invention has a benefit during closing of the line contacts of the main power switch. As the toggle lever is moved into the closed condition for the line contacts, the toggle first closes the snap-action contacts. Then full movement of the extension or finger engages the microswitch which closes the override circuit allowing activation at full power for the power source. In both opening and closing of the main contacts, there is a delay during which the power source is disabled, so the contacts actually switching the supply to and from the power source are first to close, but last to open relative to the enabled power source.

In accordance with the present invention there is provided a power switch for selectively connecting a power source to an input power supply where the power source has an override circuit to deactivate the power source when in a first condition and allowing activation of the power source when in a second condition. The power switch of the present invention has snap-acting electrical contacts movable between an open condition with the power source electrically disconnected from the power supply and a closed condition with the power source electrically connected to the power supply and an operating lever movable between a first position with the switch contacts in the open condition and a second position with the switch contacts in the closed position. The power switch also has, in accordance with the invention, an auxiliary switch in the override circuit with a movable element having a first orientation to shift the override circuit into the first disenabled condition and a second orientation to shift the override circuit into the second enabled condition. The lever of the main power switch causes the movable element of the auxiliary switch to move into the first orientation before the lever of the power switch moves to the first position during the movement of the lever from the second position connecting the power source to the first position disconnecting the power source. In accordance with an aspect of the invention, the auxiliary switch is a microswitch with a normally open contact in series in the protection circuit of the welder. The power switch is, in the preferred embodiment, the input power switch for an electric arc welder or plasma cutter. In accordance with the invention, the main power switch has a standard toggle lever so that the switch toggles between the open condition and closed condition of the input main power contacts.

In accordance with another aspect of the present invention there is provided a power switch for selectively connecting a power source to an input power supply. The power switch has an operating lever movable between a connecting position and disconnecting position. In accordance with the invention, an auxiliary switch with a first switch condition disabling the power source and a second condition enabling the power source. The auxiliary switch is provided with an element or actuator for shifting between the two conditions. The power switch has a lever with an extension or finger engaging the movable elements or actuator of the auxiliary switch. When the lever is in the line contact connecting position, the lever shifts the element into the second condition activating or enabling the power source. The element or actuator is released when the lever is moved from the connecting position toward the disconnecting position. This shifts the contacts in the protective circuit into the disabling normally open condition.

The primary object of the present invention is the provision of an improvement in a standard input toggle switch of a power source of the type used for electric arc welders, which input power switch includes an auxiliary switch for deactivating the power source before the main switch is disconnected.

Another object of the invention is the provision of a main mechanical power switch for a welder and/or plasma cutter, which main power switch deactivates or disables the power source prior to shifting the main switch from the connected condition to the disconnected condition.

Yet another object of the present invention is the provision of a power switch, as defined above, which power switch allows a standard toggle switch to cause reduced arcing and have reduced heating as it is shifted many times between the connected condition and the disconnected condition.

These and other objects and advantages will become apparent from the following description taken together with the accompanying drawings.

PREFERRED EMBODIMENT

Figure 1:
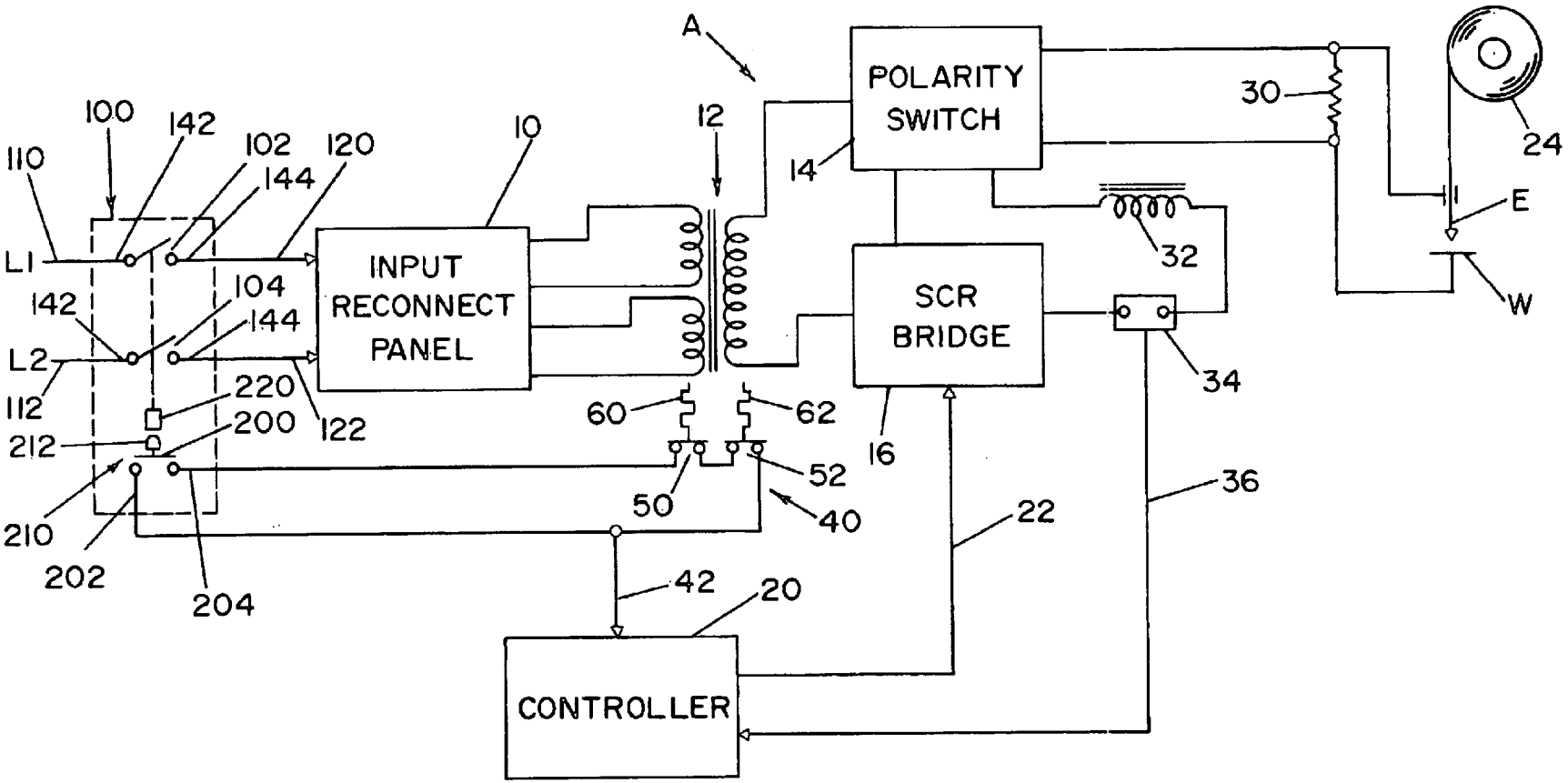
FIG. 1 is a wiring diagram showing the preferred embodiment of the present invention.
Figure 2:
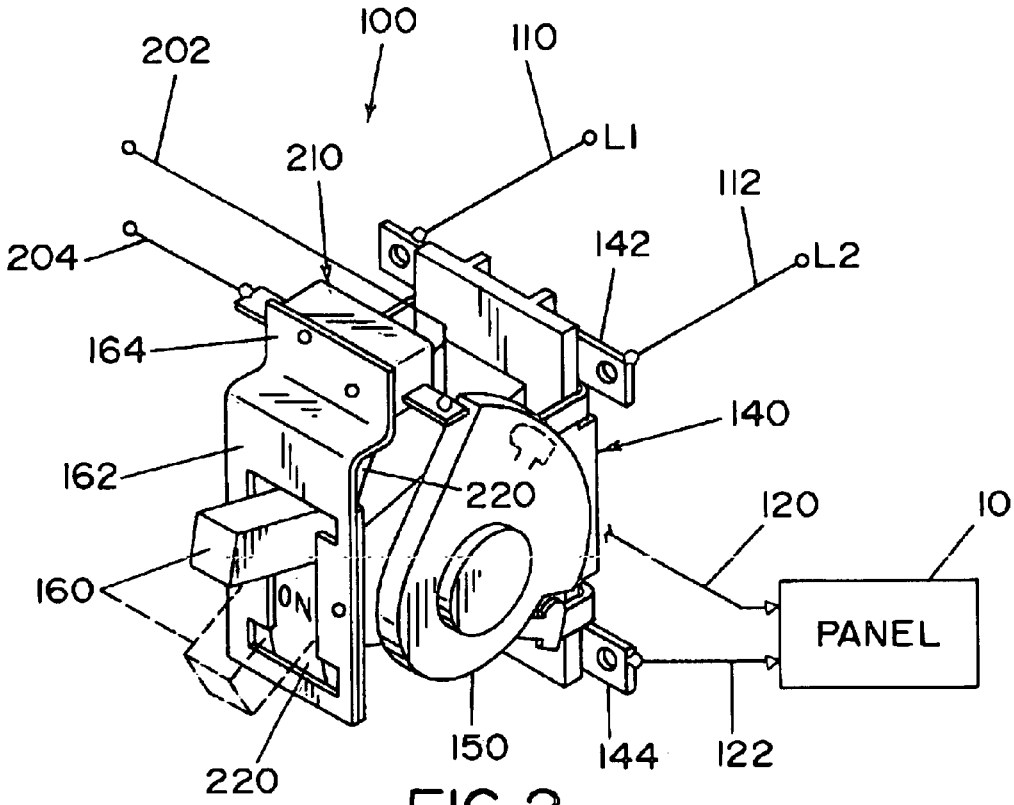
FIG. 2 is a pictorial view of a standard input toggle power switch used in electric arc welders and provided with a microswitch used in the present invention.
Figure 3:
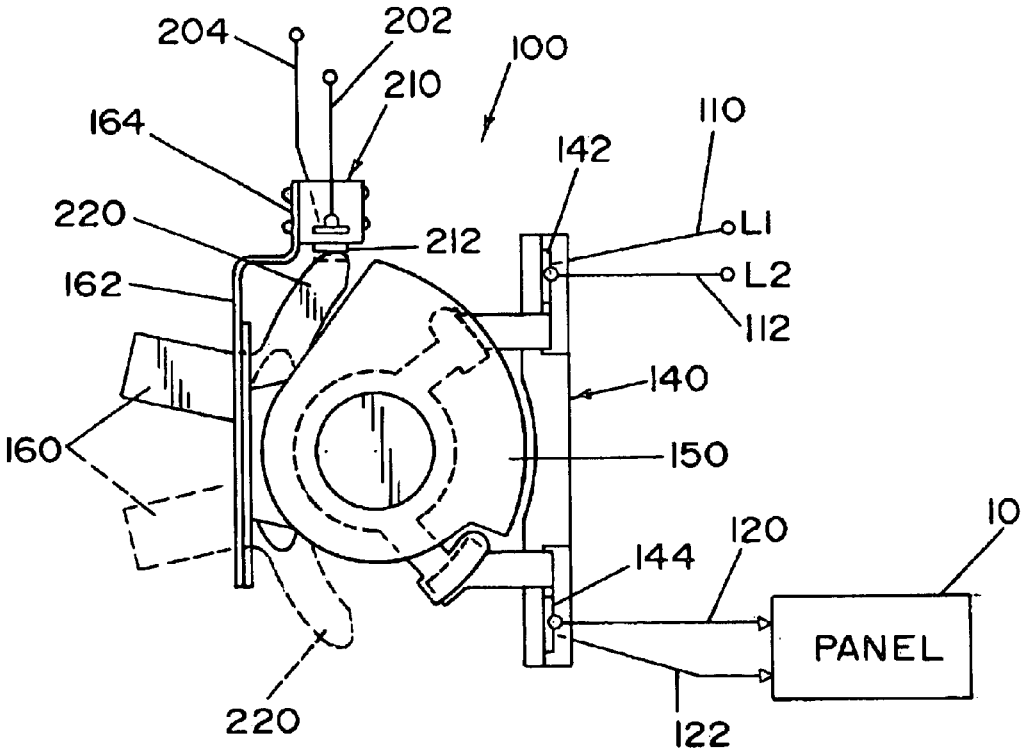
FIG. 3 is a side view of the pictorial view shown in FIG. 2 illustrating the toggle lever in a solid line condition connecting the power source to the input power supply and a dashed line toggle position disconnecting or disabling the power source from the input supply.

Referring now to the drawings, wherein the showings are for the purposes of illustrating a preferred embodiment of the invention only and not for the purpose of limiting same, FIG. 1 shows a welder A having an input reconnect panel 10 with an output transformer 12 directing current controlled by an SCR bridge 16 through a polarity switch network 14. Standard controller 20 has a control or command line 22 that determines the operation of SCR bridge 16 for performing an electric arc welding operation between electrode E and workpiece W. Electrode E is a welding wire provided by spool 24 in this embodiment. SCR holding resistor 30 is connected in parallel between electrode E and workpiece W in accordance with standard welding technology. Choke 32 controls current flow. Controller 20 receives a current signal from current shunt 34 as indicated by line 36. A standard override or temperature protection circuit 40 controls the logic on line 42 to enable controller 20. In accordance with standard technology, circuit 40 includes normally closed contacts 50, 52 operated by thermostats 60, 62 in accordance with the heat from transformer 12 or other components in the welder. As so far described, welder A involves normal welding technology. The invention is in the area of the mechanical main input switch 100, shown in FIG. 1 as a dashed line box. The switch connects the power supply shown as a single phase line voltage having lines L1, L2. This supply is to be connected to input reconnect panel 10 forming the input of the power source of welder A. Switch 100 is illustrated as having contacts 102, 104 for connecting input lines 110, 112 with output lines 120, 122, respectively. As shown in FIGS. 2 and 3, lines 120, 122 are directed to panel 10 forming the input stage of the power source. Referring now more particularly to FIGS. 2 and 3, main power switch 100 is standard snap-action toggle switch commonly used in the welders. It includes a mounting insulator plate 140 having contacts 142, 144. The contacts 142, 144 are connected or disconnected by swinging segment 150 having internal arcuate copper contacts to engage and disengage spaced copper blades extending into the switch from the contacts at the back of insulator plate 140.

Both input line L1 and L2 have contacts 142, 144 as represented in FIG. 3. Segment 150 (two are used on switch 100) is shifted between a connecting and non-connecting position by manually moving toggle lever 160 supported by a metal front plate or bracket 162. As so far described, toggle switch 100 is standard. Lever 160 is shifted by a snap-action between a solid line position with contacts 102, 104 closed to the dashed line position with these contacts opened. Segment 150 pivots back and forth to either connect the line contacts or disengage the line contacts. Plate or bracket 162 of the toggle switch is provided with an upwardly extending flange 164 forming the mounting platform for microswitch 210 that converts standard switch 100 to an improved mechanical switch in accordance with the invention. Turning back to FIG. 1, a normally opened contact 200 can connect leads 202, 204 in series with switches 50, 52 of standard protective circuit 40. An auxiliary switch in the form of microswitch 210 is mounted on flange 164. As shown in FIG. 3, and schematically in FIG. 1, switch 210 includes a standard actuator 212 that is a movable element. It is depressed to close contact 200 and released to open this contact Contact 200 is not operated directly with contacts 102, 104. An extension or finger 220 on toggle lever 160 engages actuator or movable element 212 for the purposes of closing normally closed contact 200, as shown in FIG. 3.

In operation, when toggle lever 160 is in the solid line position shown in FIGS. 2 and 3, actuator 212 is depressed by extension or finger 220. This closes contact 200 causing the logic on line 42 to SCR bridge 16 through controller 20 and control line 22. As toggle lever 160 is moved downwardly as shown in FIG. 3, the first action is for finger 220 to release actuator 212. This opens contact 200 and deactivates or disables SCR bridge 16 through controller 20. Further movement of the toggle lever into the dashed line position shown in FIG. 3 opens contacts 102, 104. Thus, release of actuator 212 of microswitch 210 to deactivate or disable the power source including bridge 16. The power source is then disconnected from the input power supply at a low current. This reduces the temperature and prevents arc. The depressed position of actuator or movable element 212 is a second condition of circuit 40 enabling the power source. The released position is a first condition of circuit 40 disabling the power source. This is done in unison with snap-action of toggling lever 160 between a down first position disconnecting the line contacts and an up position connecting the line contacts. As switch 100 is toggled into the closed position, lever 160 moves up to depress actuator 212. Contact 200 is closed to enable operation of welder A.

Figure 4:
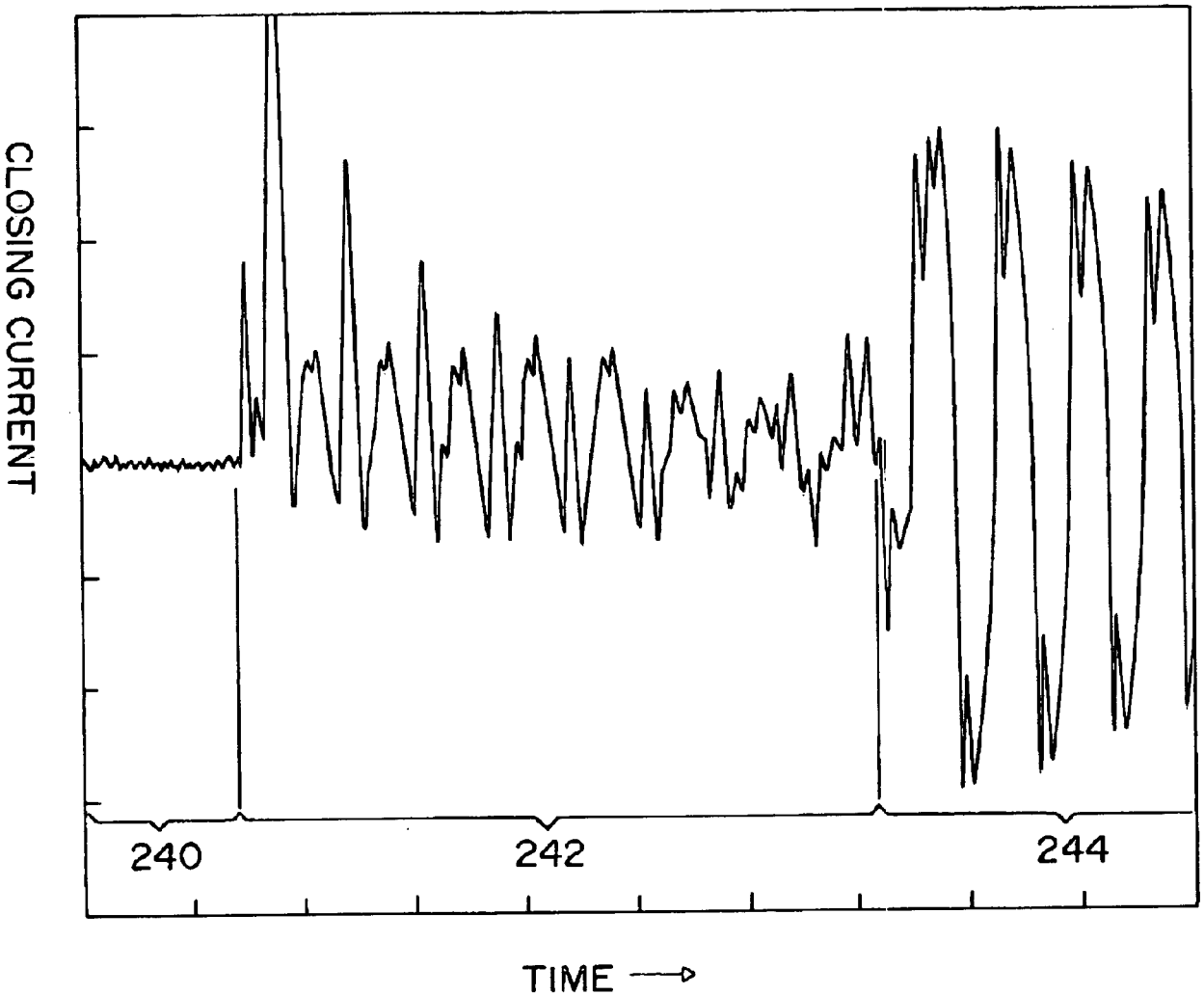
FIG. 4 is a current graph illustrating the turn-on sequence of a switch using the present invention; and, FIG. 5 is a current graph showing the turn-off sequence of a power switch utilizing the present invention.
Figure 5:
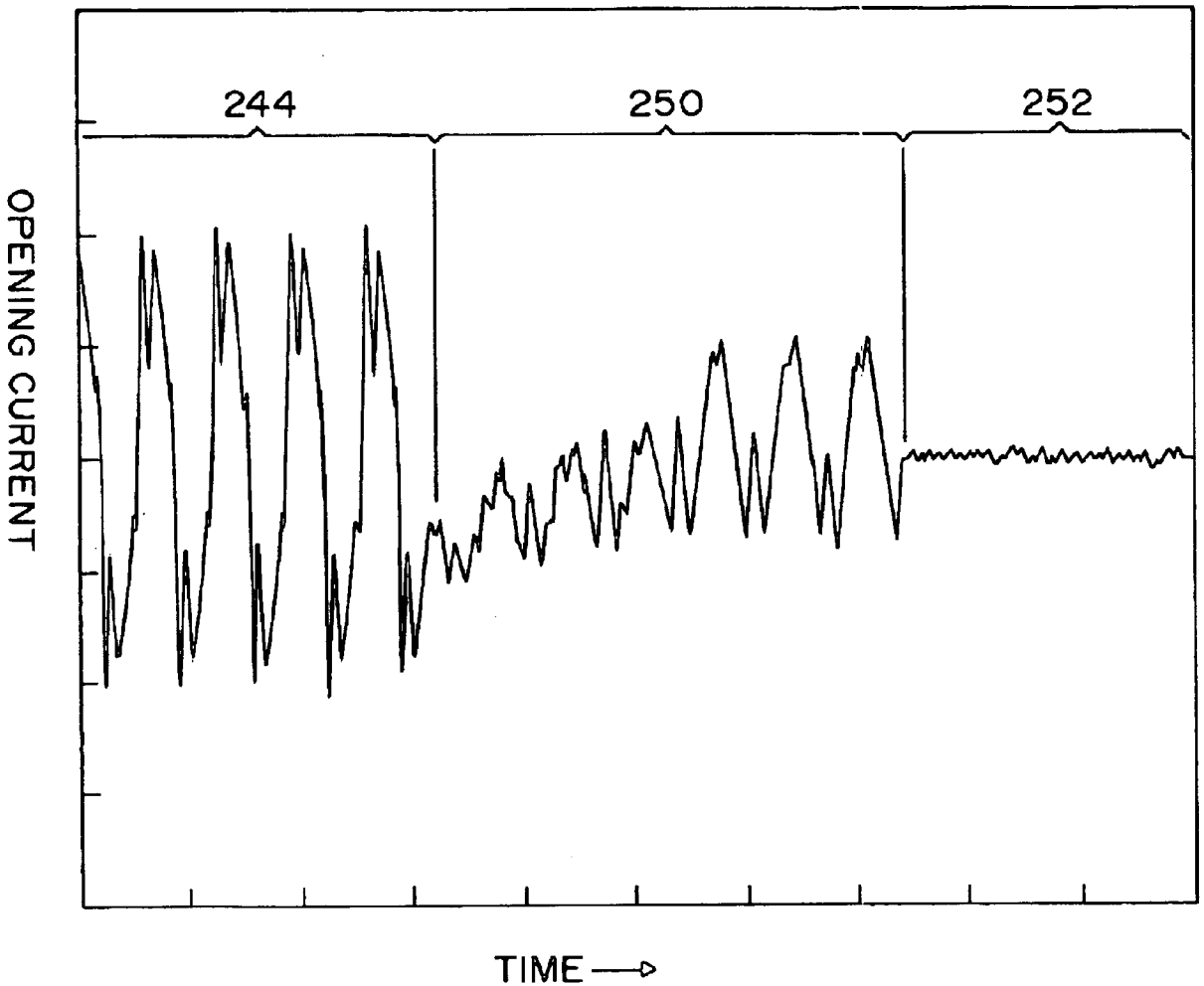

The current graph during operation of switch 100 to connect the power source to the input power supply is shown in FIG. 4. In area 240 the power source or bridge 16 is disconnected. Contacts 102, 104 are opened and contact 200 is opened. Lever 160 is down. Then toggle lever 160 is moved upwardly as shown in FIG. 3 until the snap-action contacts close to allow idle input current to flow. This is shown in area 242 of FIG. 4. Full upward movement of toggle lever 160 causes extension or finger 220 to close contact 200 by extension 220 engaging and depressing actuator 214. This enables the output load current of welder A and is shown in area 244 of FIG. 4. The main contacts 102, 104 are closed and the welder is at full power. Thereafter, the welder operates in accordance with standard technology to perform a welding operation between electrode E and workpiece W with welding wire from spool 24. To disconnect the power source of welder A, toggle lever 160 is moved downwardly releasing finger 220 from actuator 212. This sequence is shown in FIG. 5. Area 244 of FIG. 4 is the initial area of FIG. 5. Contact 200 is opened when actuator 212 is released. This deactivates the power source of welder A due to the logic on line 42 directed to controller 20 to shut off SCR bridge 16 to cause only idle input current. This is area 250. Further movement of toggle lever 160 into the dashed line position shown in FIG. 3, opens the contacts 102, 104 to disconnect the power source of the welder, as shown in area 252. Consequently, the activation and deactivation of the standard main input power switch 100 is accomplished at a low current determined by deactivation of the power source using a normal protection override circuit 40. Since low current exists when connecting and disconnecting the power source of the welder from the main power supply, reduced temperature and arcing is obtained.

Having thus defined the invention the following is claimed:

1. A mechanical power switch for selectively connecting a power source to an input power supply where said power source has an override circuit to deactivate or disable said power source when in a first condition and allowing activation or enable of said power source when in a second condition, said power switch having electrical contacts movable between an open condition with said power source electrically disconnected from said power supply and a closed condition with said power source electrically connected to said power supply and an operating lever movable between a first position with said electrical contacts in said open condition and a second position with said electrical contacts in said closed condition, said switch also having an auxiliary switch in said override circuit with a movable element having a first orientation to shift said override circuit into said first deactivate condition and a second orientation to shift said override circuit into said second activate condition, and said power switch lever causing said movable element to move into said first orientation before said electrical contacts move to said open condition but during movement of said lever from said second position to said first position.

2. A power switch as defined in claim 1 wherein said element moves to said first orientation when said lever moves from said second position toward said first position a set amount.

3. A power switch as defined in claim 2 wherein said auxiliary switch is a microswitch with an actuator constituting said movable element.

4. A power switch as defined in claim 3 wherein said power switch lever causes said movable element to move into said second orientation before said electrical contacts move to said closed condition.

5. A power switch as defined in claim 4 wherein said operating lever is a toggle lever to toggle between said first and second positions.

6. A power switch as defined in claim 3 wherein said operating lever is a toggle lever to toggle between said first and second positions.

7. A power switch as defined in claim 3 wherein said power source is attached to an electric arc welder.

8. A power switch as defined in claim 2 wherein said power switch lever causes said movable element to move into said second orientation before said electrical contacts move to said closed condition.

9. A power switch as defined in claim 8 wherein said operating lever is a toggle lever to toggle between said first and second positions.

10. A power switch as defined in claim 2 wherein said operating lever is a toggle lever to toggle between said first and second positions.

11. A power switch as defined in claim 10 wherein said power source is attached to an electric arc welder.

12. A power switch as defined in claim 2 wherein said power source is attached to an electric arc welder.

13. A power switch as defined in claim 1 wherein said auxiliary switch is a microswitch with an actuator constituting said movable element.

14. A power switch as defined in claim 13 wherein said power switch lever causes said movable element to move into said second orientation after said electrical contacts move to said closed condition.

15. A power switch as defined in claim 14 wherein said operating lever is a toggle lever to toggle between said first and second positions.

16. A power switch as defined in claim 13 wherein said operating lever is a toggle lever to toggle between said first and second positions.

17. A power switch as defined in claim 13 wherein said power source is attached to an electric arc welder.

18. A power switch as defined in claim 1 wherein said power switch lever causes said movable element to move into said second orientation before said electrical contacts move to said closed condition.

19. A power switch as defined in claim 18 wherein said operating lever is a toggle lever to toggle between said first and second positions.

20. A power switch as defined in claim 18 wherein said power source is attached to an electric arc welder.

21. A power switch as defined in claim 1 wherein said operating lever is a toggle lever to toggle between said first and second positions.

22. A power switch as defined in claim 21 wherein said power source is attached to an electric arc welder.

23. A power switch as defined in claim 1 wherein said power source is attached to an electric arc welder.

24. A mechanical power switch for selectively connecting a power source to an input power supply, said switch having an operating lever movable between a connecting position and a disconnecting position, an auxiliary switch with a first condition deactivating the power source and second condition activating said power source and a movable element for shifting between said conditions, said power switch lever having an extension engaging said element when said lever is in said connecting position to shift said element into said second condition after said power source is connected to said input power supply and disengaging said element before said power source is disconnected from said input power supply when said lever is moved from said connecting position toward said disconnecting position.

25. A power switch as defined in claim 24 wherein said auxiliary switch is a microswitch with an actuator constituting said movable element.

26. A power switch as defined in claim 25 wherein said operating lever is a toggle lever to toggle between said first and second positions.

27. A power switch as defined in claim 26 wherein said power source is attached to an electric arc welder.

28. A power switch as defined in claim 27 wherein said power supply is a single phase AC line.

29. A power switch as defined in claim 25 wherein said power source is attached to an electric arc welder.

30. A power switch as defined in claim 29 wherein said power supply is a single phase AC line.

31. A power switch as defined in claim 24 wherein said operating lever is a toggle lever to toggle between said first and second positions.

32. A power switch as defined in claim 31 wherein said power source is attached to an electric arc welder.

33. A power switch as defined in claim 32 wherein said power supply is a single phase AC line.

34. A power switch as defined in claim 24 wherein said power source is attached to an electric arc welder.

35. A power switch as defined in claim 34 wherein said power supply is a single phase AC line.

36. A power switch as defined in claim 24 wherein said power supply is a single phase AC line.

* * * * *